US010312036B2

(12) United States Patent
Chen

(10) Patent No.: US 10,312,036 B2
(45) Date of Patent: Jun. 4, 2019

(54) KEYBOARD DEVICE

(71) Applicant: Primax Electronics Ltd., Taipei (TW)

(72) Inventor: Bo-An Chen, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/790,967

(22) Filed: Oct. 23, 2017

(65) Prior Publication Data

US 2018/0358194 A1 Dec. 13, 2018

(30) Foreign Application Priority Data

Jun. 9, 2017 (TW) ..... 106119279 A

(51) Int. Cl.
*H01H 13/86* (2006.01)

(52) U.S. Cl.
CPC ..... *H01H 13/86* (2013.01); *H01H 2233/002* (2013.01); *H01H 2233/03* (2013.01); *H01H 2233/07* (2013.01)

(58) Field of Classification Search
CPC ..... H01H 13/86; H01H 2233/002; H01H 2233/03; H01H 2233/07
USPC ..... 200/5 A, 344, 515
See application file for complete search history.

(56) References Cited

U.S. PATENT DOCUMENTS 4,349,712 A * 9/1982 Michalski ..... H01H 13/702 200/5 A
4,415,780 A * 11/1983 Daugherty ..... H01H 13/702 200/5 A
6,686,549 B2 * 2/2004 Douzono ..... G06F 3/0202 200/341
2008/0073186 A1 * 3/2008 Kenmochi ..... H01H 13/703 200/5 A
2010/0213044 A1 * 8/2010 Strittmatter ..... H01H 13/702 200/515

* cited by examiner

*Primary Examiner* — Renee S Luebke
*Assistant Examiner* — Iman Malakooti
(74) *Attorney, Agent, or Firm* — Kirton McConkie; Evan R. Witt

(57) ABSTRACT

A keyboard device includes plural key structures, a switch circuit board, an elastic cover and a seal element. The switch circuit board includes a hollow region. The elastic cover is disposed on the switch circuit board. The hollow region is covered by the elastic cover, so that a foreign liquid is prevented from entering the switch circuit board. The seal element is disposed on sidewalls of the switch circuit board. Consequently, a sealed region is formed between the switch circuit board and the elastic cover. When the inner gas within the switch circuit board is changed, the elastic cover is subjected to expansion or contraction. Consequently, the switch circuit board is not subjected to deformation in response to the volume change of the inner gas.

9 Claims, 6 Drawing Sheets

KEYBOARD DEVICE

FIELD OF THE INVENTION

The present invention relates to an input device, and more particularly to a keyboard device with plural key structures.

BACKGROUND OF THE INVENTION

Generally, the widely-used peripheral input device of a computer system includes for example a mouse device, a keyboard device, a trackball device, or the like. Via the keyboard device, characters or symbols can be directly inputted into the computer system. As a consequence, most users and most manufacturers of input devices pay much attention to the development of keyboard devices.

Hereinafter, a key structure with a scissors-type connecting element in a conventional keyboard will be illustrated with reference to FIG. 1. FIG. 1 is a schematic side cross-sectional view illustrating a conventional key structure. As shown in FIG. 1, the conventional key structure 1 comprises a keycap 11, a scissors-type connecting element 12, a rubbery elastomer 13, a membrane switch circuit member 14 and a base plate 15. The keycap 11, the scissors-type connecting element 12, the rubbery elastomer 13 and the membrane switch circuit member 14 are supported by the base plate 15. The scissors-type connecting element 12 is used for connecting the base plate 15 and the keycap 11.

The scissors-type connecting element 12 is arranged between the base plate 15 and the keycap 11, and the base plate 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base plate 15. The rubbery elastomer 13 is enclosed by the scissors-type connecting element 12. The membrane switch circuit member 14 comprises plural key intersections (not shown). When one of the plural key intersections is triggered, a corresponding key signal is generated. The rubbery elastomer 13 is disposed on the membrane switch circuit member 14. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The operations of the conventional key structure 1 in response to the depressing action of the user will be illustrated as follows. Please refer to FIG. 1 again. When the keycap 11 is depressed, the keycap 11 is moved downwardly to push the scissors-type connecting element 12 in response to the depressing force. As the keycap 11 is moved downwardly relative to the base plate 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed.

Generally, if the foreign liquid is introduced into the key structure, the membrane switch circuit member is possibly in a short-circuited state. For solving this problem, the membrane switch circuit member is designed to be a sealed structure with a waterproof function. Since the inner space of the sealed membrane switch circuit member contains gas, the inner gas is subjected to expansion or contraction in response to the temperature change. When the temperature increases, the volume of the inner gas expands. Consequently, it is difficult to make electric conduction of the key intersection of the membrane switch circuit member. When the temperature decreases, the volume of the inner gas contracts. Meanwhile, it is easy to make electric conduction of the key intersection of the membrane switch circuit member. However, the keyboard device is possibly suffered from an error operation. For easing the electric conduction of the membrane switch circuit member, the membrane switch circuit member membrane switch circuit member is equipped with a gas-escaping channel to escape the gas from the membrane switch circuit member. Due to the arrangement of the gas-escaping channel, the membrane switch circuit member is not the sealed structure. Under this circumstance, the waterproof efficacy is deteriorated.

Therefore, there is a need of providing a keyboard device with a waterproof function and capable of avoiding error operation.

SUMMARY OF THE INVENTION

The present invention provides a keyboard device with a waterproof function and capable of avoiding error operation.

In accordance with an aspect of the present invention, there is provided a keyboard device. The keyboard device includes plural key structures, a switch circuit board, an elastic cover and a seal element. The plural key structures are exposed outside the keyboard device. The switch circuit board is located under the plural key structures. When the switch circuit board is triggered by one of the plural key structures, a corresponding key signal is generated. The switch circuit board includes a hollow region. The elastic cover is disposed on the switch circuit board. The hollow region is covered by the elastic cover, so that a foreign liquid is prevented from entering the switch circuit board. The seal element is disposed on sidewalls of the switch circuit board. Consequently, a sealed region is formed between the switch circuit board and the elastic cover to prevent the foreign liquid from entering the switch circuit board. When a volume of an inner gas within the sealed region increases, the elastic cover is subjected to expansion in response to elasticity of the elastic cover and the volume of the inner gas. When the volume of the inner gas within the sealed region decreases, the elastic cover is subjected to contraction in response to elasticity of the elastic cover and the volume of the inner gas.

From the above descriptions, the present invention provides the keyboard device. The elastic cover is disposed on the switch circuit board. Since no gas-escaping channel is installed in the switch circuit board, the sealed region in the switch circuit board can be maintained. Consequently, the keyboard device of the present invention has the waterproof function. When the temperature is changed and the inner gas within the switch circuit board is correspondingly changed, the elastic cover is subjected to expansion or contraction in response to the volume change of the inner gas and the elasticity of the elastic cover. Consequently, the distance between the first contact and the second contact of the switch circuit board can be maintained. In other words, the electric connection between the first contact and the second contact is established more easily and the problem of causing the erroneous operation is overcome.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a keyboard device.

Figure 1:
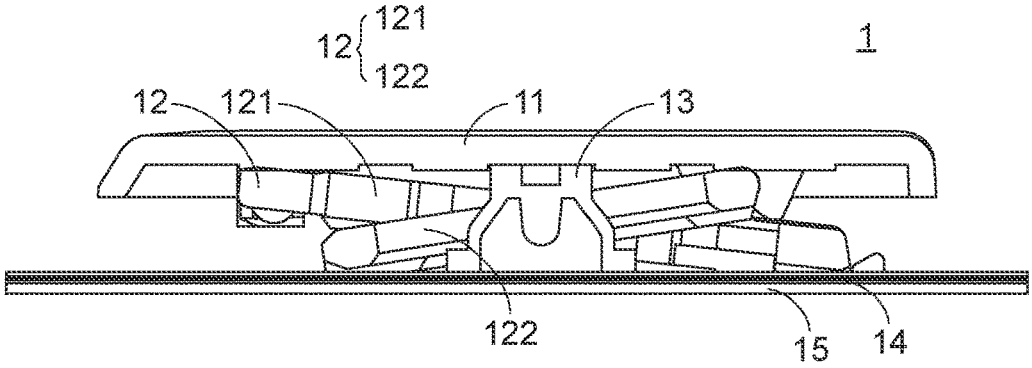
FIG. 1 PRIOR ART
FIG. 1 is a schematic side cross-sectional view illustrating a conventional key structure.
Figure 2:
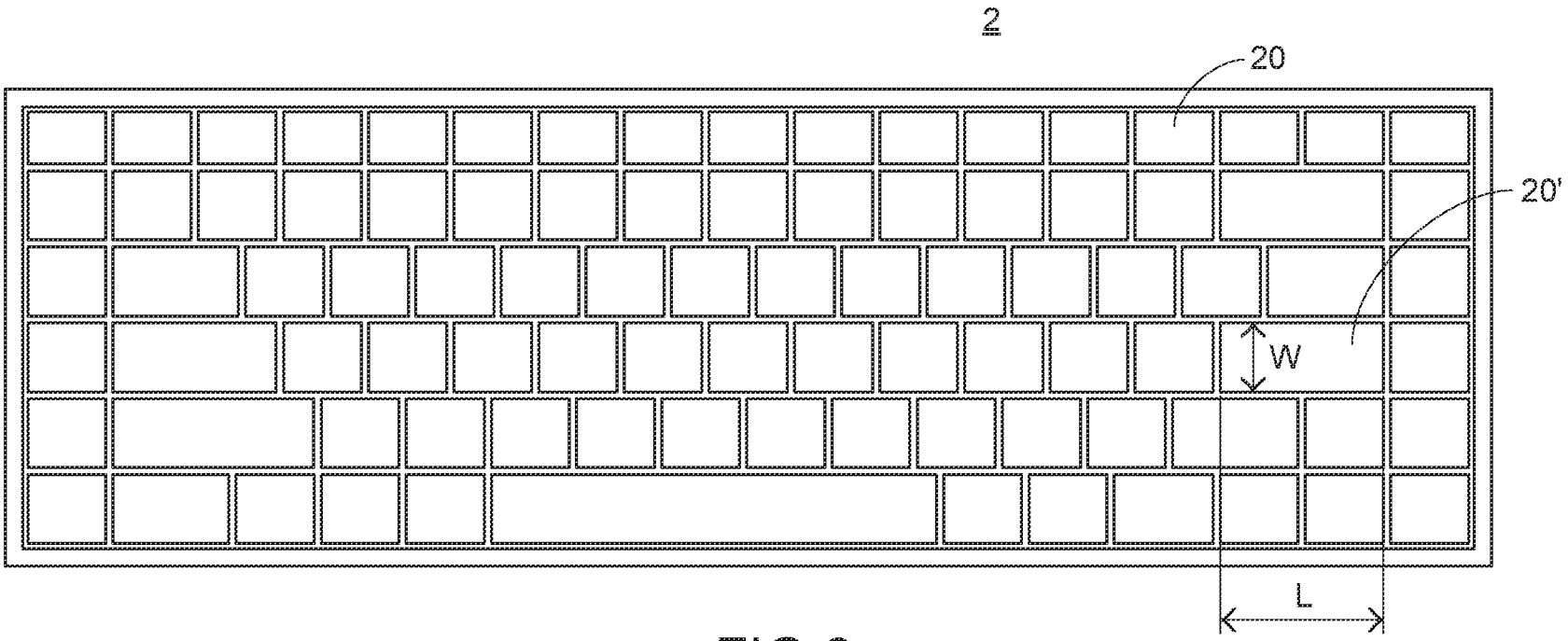
FIG. 2 is a schematic top view illustrating the outer appearance of a keyboard device according to a first embodiment of the present invention

Hereinafter, the structure of a keyboard device of the present invention will be described with reference to FIG. 2. FIG. 2 is a schematic top view illustrating the outer appearance of a keyboard device according to a first embodiment of the present invention. The keyboard device 2 comprises plural key structures 20 and 20'. The plural key structures 20 and 20' are exposed outside the keyboard device 2. When one of the key structures 20 and 20' is depressed by the user's finger, a corresponding key signal is generated to a computer (not shown) that is in communication with the keyboard device 2. According to the key signal, the computer executes a function corresponding to the depressed key structure. The length of the key structure 20 is slightly larger than the width of the key structure 20. The length L of the key structure 20' is much larger than the width W of the key structure 20'. Consequently, the key structure 20' is also referred as a multiple key.

Figure 3:
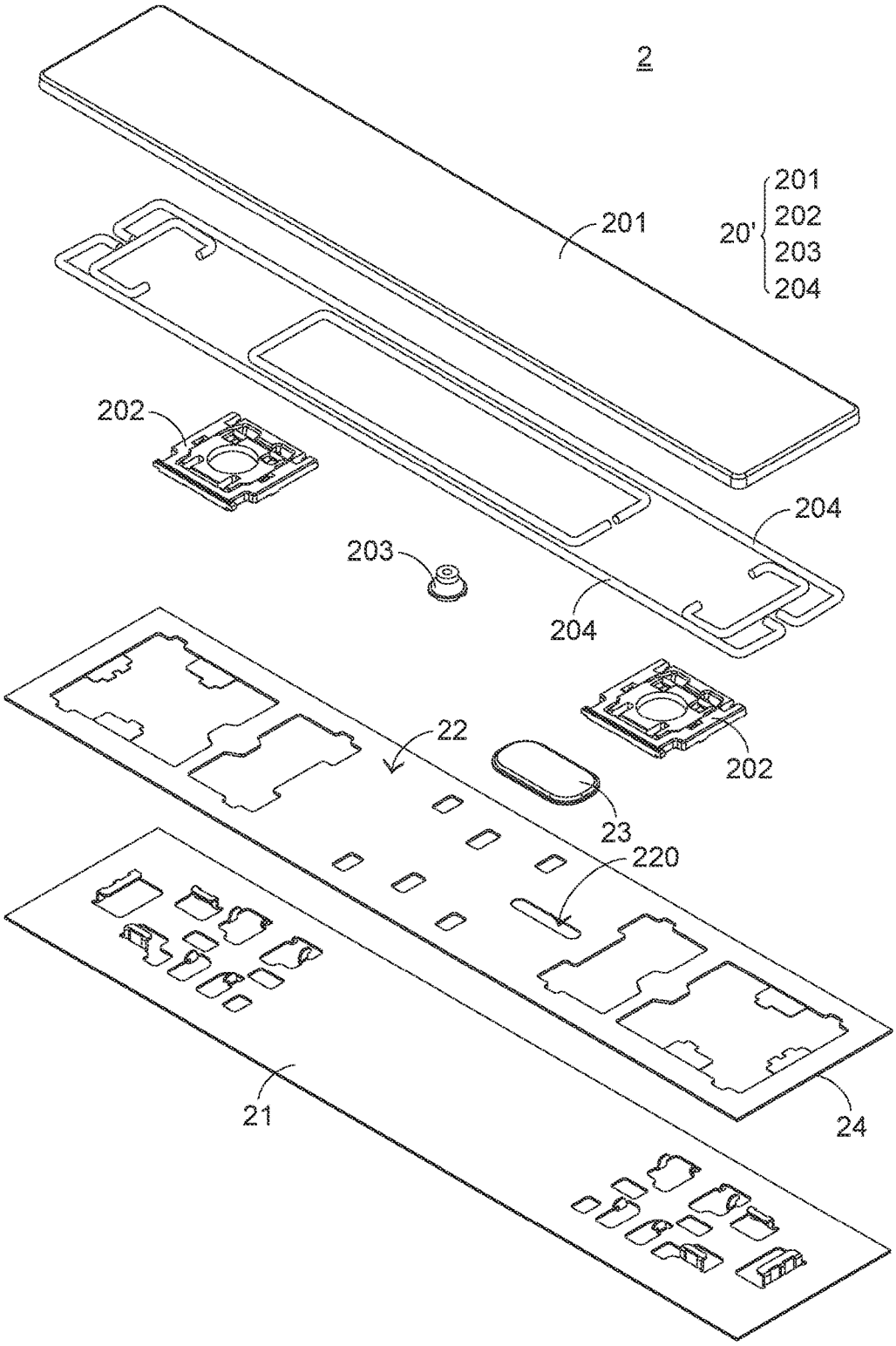
FIG. 3 is a schematic exploded view illustrating a portion of the keyboard device according to the first embodiment of the present invention.

The inner structure of the keyboard device 2 will be described as follows. For succinctness, only the key structure 20' is shown. FIG. 3 is a schematic exploded view illustrating a portion of the keyboard device according to the first embodiment of the present invention. In addition to the plural key structures 20 and 20', the keyboard device 2 further comprises a base plate 21, a switch circuit board 22, an elastic cover 23 and a seal element 24. The base plate 21 is located under the key structure 20'. The switch circuit board 22 is arranged between the key structure 20' and the base plate 21. When the switch circuit board 22 is triggered by the key structure 20', the corresponding key signal is generated. A hollow region 220 of the switch circuit board 22 is exposed outside. The elastic cover 23 is disposed on the switch circuit board 22 and aligned with the hollow region 220. Moreover, the hollow region 220 is covered by the elastic cover 23. Consequently, the foreign liquid A (see FIG. 4) is prevented from entering the switch circuit board 22. The seal element 24 is disposed on sidewalls of the switch circuit board 22. Consequently, a sealed region 25 (see FIG. 4) is formed between the switch circuit board 22 and the elastic cover 23. In such way, the foreign liquid A is prevented from entering the switch circuit board 22.

Each of the key structures 20' of the keyboard device 2 comprises a keycap 201, at least one scissors-type connecting element 202, an elastic element 203 and plural stabilizer bars 204. The scissors-type connecting element 202 is connected with the corresponding keycap 201 and the base plate 21. Through the scissors-type connecting element 202, the keycap 201 is fixed on the base plate 21 and movable relative to the base plate 21. The elastic element 203 is arranged between the corresponding keycap 201 and the switch circuit board 22. When the elastic element 203 is pushed by the keycap 201, the switch circuit board 22 is triggered. The plural stabilizer bars 204 are connected with the keycap 201 and the base plate 21. As the plural stabilizer bars 204 are swung, the plural stabilizer bars 204 assist in the movement of the keycap 201. Consequently, the moving stability of the keycap 201 is enhanced. In an embodiment, the base plate 21 and the plural stabilizer bars 204 are made of metallic material, the elastic element 203 is a rubbery elastomer, and the scissors-type connecting element 202 is made of plastic material.

Figure 4:
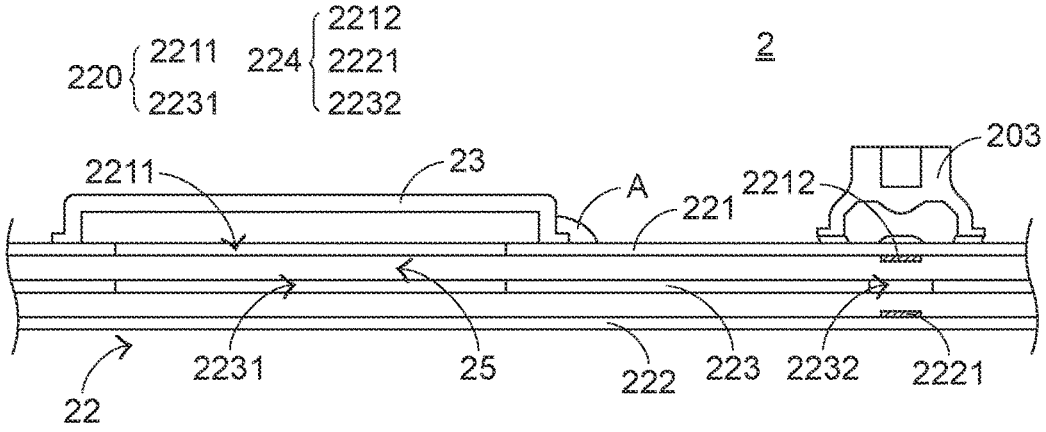
FIG. 4 is a schematic cross-sectional side view illustrating a portion of the keyboard device according to the first embodiment of the present invention.

FIG. 4 is a schematic side cross-sectional view illustrating a portion of the keyboard device according to the first embodiment of the present invention. Please refer to FIGS. 3 and 4. The switch circuit board 22 comprises an upper wiring plate 221, a lower wiring plate 222, a separation layer 223 and a key intersection 224. The upper wiring plate 221 comprises a first opening 2211 and a first contact 2212. The lower wiring plate 222 is located under the upper wiring plate 221. Moreover, the lower wiring plate 222 comprises a second contact 2221 corresponding to the first contact 2212. The separation layer 223 is arranged between the upper wiring plate 221 and the lower wiring plate 222. Moreover, the separation layer 223 comprises a second opening 2231 and a third opening 2232. The hollow region 220 is defined by the first opening 2211 and the second opening 2231 collaboratively. Moreover, the key intersection 224 is defined by the first contact 2212, the second contact 2221 and the third opening 2232 collaboratively. In an embodiment, the switch circuit board 22 is a membrane circuit board, and the seal element 24 is a waterproof adhesive.

The sidewalls of the upper wiring plate 221, the sidewalls of the separation layer 223 and the sidewalls of the lower wiring plate 222 are covered by the seal element 24. Consequently, the seal element 24 is disposed on the sidewalls of the switch circuit board 22. Generally, the spaces between the upper wiring plate 221, the lower wiring plate 222 and the separation layer 223 of the switch circuit board 22 contain gas. After the seal element 24 is disposed on the sidewalls of the switch circuit board 22, the gas is still contained in the sealed region 25 of the switch circuit board 22. As shown in FIG. 4, the first opening 2211 of the upper wiring plate 221 is covered by the elastic cover 23 from the top side of the upper wiring plate 221. Moreover, the elastic cover 23 is fixed on the upper wiring plate 221 by a hot pressing process or an attaching process. Consequently, the foreign liquid A is prevented from entering the sealed region 25 of the switch circuit board 22. In an embodiment, the elastic cover 23 is made of silicone rubber. It is noted that the material of the elastic cover 23 is not restricted.

The operations of depressing the key structure 20' will be described as follows. While the keycap 201 of any key structure 20' is depressed, the keycap 201 is moved downwardly relative to the base plate 21. Since the scissors-type connecting element 202 and the stabilizer bars 204 are pushed by the keycap 201, the scissors-type connecting element 202 and the stabilizer bars 204 are correspondingly swung. Moreover, as the keycap 201 is moved downwardly to push the elastic element 203, the elastic element 203 is subjected to deformation to trigger the key intersection 224 of the switch circuit board 22. Moreover, as the first contact 2212 of the key intersection 224 is pushed by the elastic element 203, the first contact 2212 is penetrated through the third opening 2232 and contacted with the second contact 2221. Consequently, the electric connection between the first contact 2212 and the second contact 2221 is established, and the key intersection 224 is triggered to generate the corresponding key signal. When the key structure 20' is no longer depressed by the user, the keycap 201 is moved upwardly relative to the base plate 21 in response to a restoring elastic force of the elastic element 203. As the keycap 201 is moved upwardly, the scissors-type connecting element 202 and the stabilizer bars 204 are correspondingly swung and switched from a stacked state to an open-scissors state again. Consequently, the keycap 201 is returned to its original position.

Figure 5:
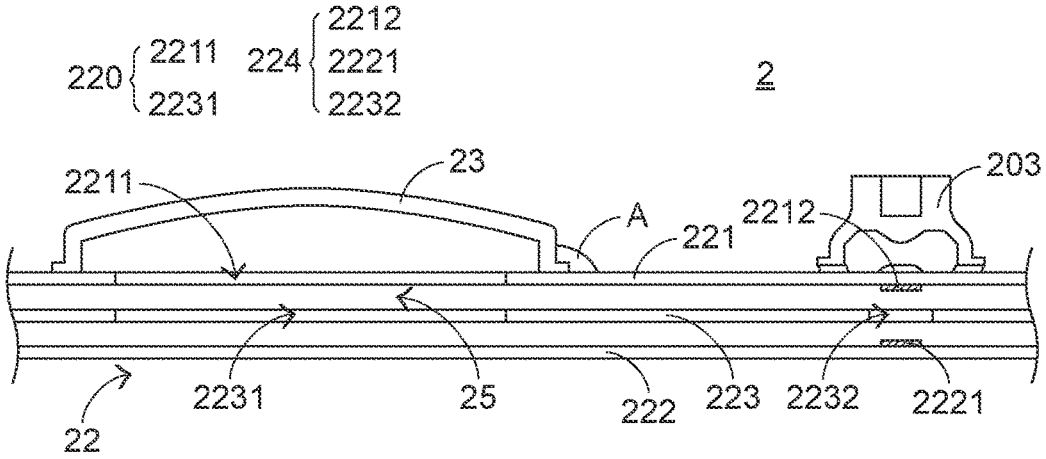
FIG. 5 is a schematic cross-sectional side view illustrating a portion of the keyboard device according to the first embodiment of the present invention, in which the elastic cover is subjected to expansion.

FIG. 5 is a schematic cross-sectional side view illustrating a portion of the keyboard device according to the first embodiment of the present invention, in which the elastic cover is subjected to expansion. Please refer to FIGS. 4 and 5. When the temperature increases, the gas within the sealed region 25 of the switch circuit board 22 is thermally expanded and the volume of the inner gas increases. Due to the elastic cover 23 and the seal element 24, the inner gas is not exhausted. Since the volume of the inner gas increases, the upper wiring plate 221, the lower wiring plate 222 and the separation layer 223 are subjected to deformation. That is, the distance between the upper wiring plate 221 and the lower wiring plate 222 is increased. Moreover, the volume of the gas within the elastic cover 23 is also increased. Due to the elasticity of the elastic cover 23, the increased volume of the inner gas is transferred to the elastic cover 23 and the elastic cover 23 is subjected to expansion. Consequently, as shown in FIG. 5, the space of the sealed region 25 is increased to accommodate the increased volume of the gas. In other words, the use of the elastic cover 23 can correct the deformation of the upper wiring plate 221, the lower wiring plate 222 and the separation layer 223. Since the distance between the first contact 2212 and the second contact 2221 is maintained, the electric connection between the first contact 2212 and the second contact 2221 can be established more easily.

Figure 6:
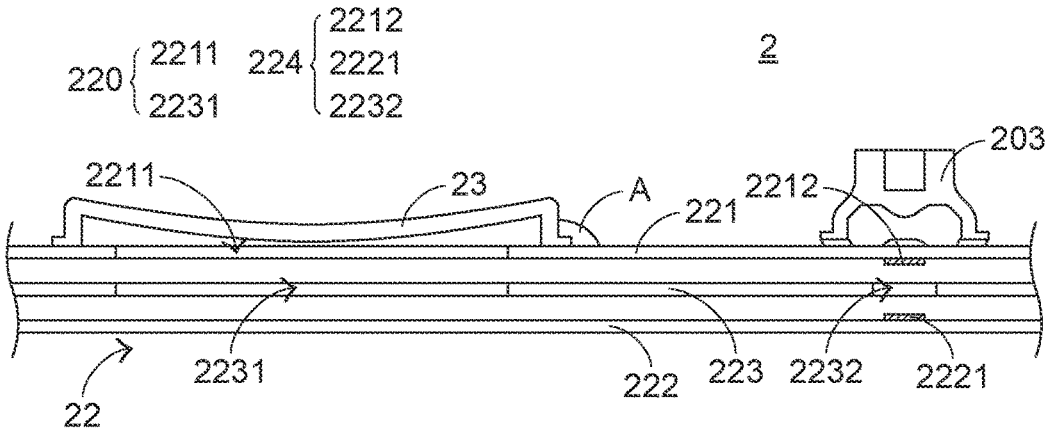
FIG. 6 is a schematic cross-sectional side view illustrating a portion of the keyboard device according to the first embodiment of the present invention, in which the elastic cover is subjected to contraction.

FIG. 6 is a schematic cross-sectional side view illustrating a portion of the keyboard device according to the first embodiment of the present invention, in which the elastic cover is subjected to contraction. Please refer to FIGS. 4 and 6. When the temperature decreases, the gas within the sealed region 25 of the switch circuit board 22 is cooled and contracted and the volume of the inner gas decreases. Since the volume of the inner gas decreases, the upper wiring plate 221, the lower wiring plate 222 and the separation layer 223 are subjected to deformation. That is, the distance between the upper wiring plate 221 and the lower wiring plate 222 is decreased. Moreover, the volume of the gas within the elastic cover 23 is also decreased. Due to the elasticity of the elastic cover 23, the elastic cover 23 is subjected to contraction. Consequently, as shown in FIG. 6, the space of the sealed region 25 is decreased. In addition, the deformation of the switch circuit board 22 is compensated. In other words, the use of the elastic cover 23 can correct the deformation of the upper wiring plate 221, the lower wiring plate 222 and the separation layer 223. Since the distance between the first contact 2212 and the second contact 2221 is maintained, the first contact 2212 and the second contact 2221 are not erroneously touched. Consequently, the possibility of causing erroneous operation is reduced.

Figure 7:
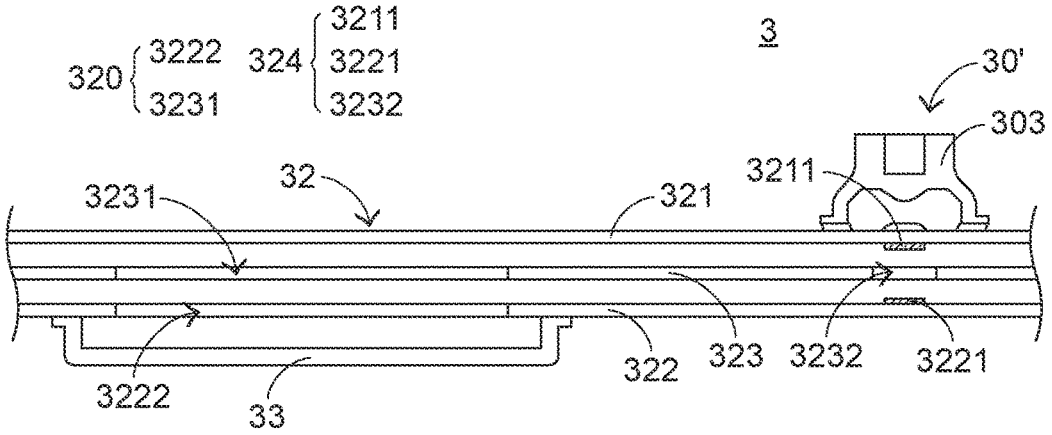
FIG. 7 is a schematic cross-sectional side view illustrating a portion of a keyboard device according to a second embodiment of the present invention.

The present invention further provides a second embodiment, which is distinguished from the first embodiment. FIG. 7 is a schematic cross-sectional side view illustrating a portion of a keyboard device according to a second embodiment of the present invention. The keyboard device 3 comprises plural key structures 30', a base plate (not shown), a switch circuit board 32, an elastic cover 33 and a seal element (not shown). Each of the key structures 30' comprises a keycap (not shown), at least one scissors-type connecting element (not shown), an elastic element 303 and plural stabilizer bars (not shown). Except for the following two items, the structures and functions of the keyboard device 3 of this embodiment are substantially identical to those of the keyboard device of the first embodiment, and are not redundantly described herein. Firstly, the structure of the switch circuit board 32 is distinguished. Secondly, the arrangement of the elastic cover 33 is distinguished.

As shown in FIG. 7, the switch circuit board 32 comprises an upper wiring plate 321, a lower wiring plate 322, a separation layer 323 and a key intersection 324. The upper wiring plate 321 comprises a first contact 3211. The lower wiring plate 322 comprises a second contact 3222 corresponding to the first contact 3211. Moreover, the lower wiring plate 322 further comprises a first opening 3222. The separation layer 323 is arranged between the upper wiring plate 321 and the lower wiring plate 322. Moreover, the separation layer 323 comprises a second opening 3231 and a third opening 3232. A key intersection 324 is defined by the first contact 3211, the second contact 3221 and the third opening 3232 collaboratively. Moreover, a hollow region 320 is defined by the first opening 3222 and the second opening 3231 collaboratively. In other words, the hollow region 320 is formed in a bottom surface of the switch circuit board 32. As shown in FIG. 7, the first opening 3222 of the lower wiring plate 322 is covered by the elastic cover 33 from the bottom side of the lower wiring plate 322. Moreover, the elastic cover 33 is fixed on the lower wiring plate 322 through a waterproof adhesive. The operations of the elastic cover 33 are similar to those of the first embodiment, and are not redundantly described herein.

Figure 8:
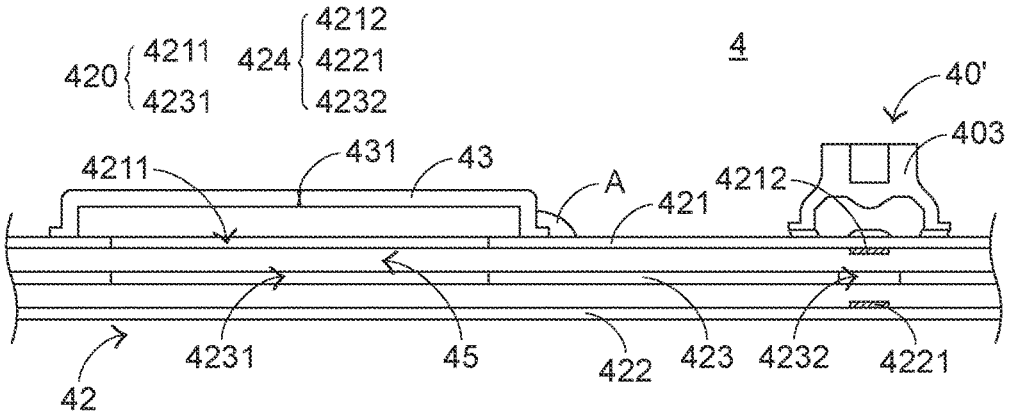
FIG. 8 is a schematic cross-sectional side view illustrating a portion of a keyboard device according to a third embodiment of the present invention.

The present invention further provides a third embodiment, which is distinguished from the above embodiments. FIG. 8 is a schematic cross-sectional side view illustrating a portion of a keyboard device according to a third embodiment of the present invention. The keyboard device 4 comprises plural key structures 40', a base plate (not shown), a switch circuit board 42, an elastic cover 43 and a seal element (not shown). Each of the key structures 40' comprises a keycap (not shown), at least one scissors-type connecting element (not shown), an elastic element 403 and plural stabilizer bars (not shown).

The switch circuit board 42 comprises an upper wiring plate 421, a lower wiring plate 422, a separation layer 423 and a key intersection 424. The upper wiring plate 421 comprises a first opening 4211 and a first contact 4212. The lower wiring plate 422 comprises a second contact 4221 corresponding to the first contact 4212. The separation layer 423 is arranged between the upper wiring plate 421 and the lower wiring plate 422. Moreover, the separation layer 423 comprises a second opening 4231 and a third opening 4232. A hollow region 420 is defined by the first opening 4211 and the second opening 4231 collaboratively. Moreover, the key intersection 424 is defined by the first contact 4212, the second contact 4221 and the third opening 4232 collaboratively. Except for the following item, the structures and functions of the keyboard device 4 of this embodiment are substantially identical to those of the keyboard device of the first embodiment, and are not redundantly described herein. For example, the structure of the elastic cover 43 is distinguished.

Figure 9:
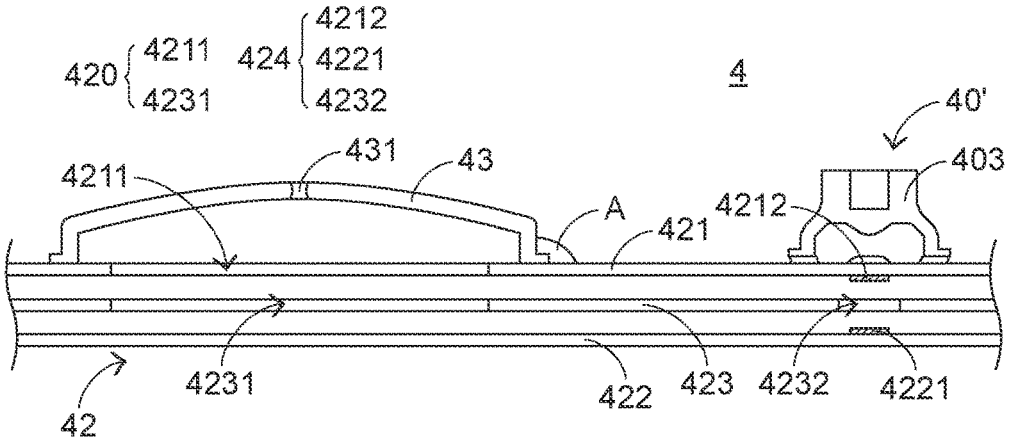
FIG. 9 is a schematic cross-sectional side view illustrating a portion of the keyboard device according to the third embodiment of the present invention, in which the elastic cover is subjected to expansion.

FIG. 9 is a schematic cross-sectional side view illustrating a portion of the keyboard device according to the third embodiment of the present invention, in which the elastic cover is subjected to expansion. Please refer to FIGS. 8 and 9. The elastic cover 43 comprises a tiny vent 431. The tiny vent 431 runs through the elastic cover 43. If the volume of the inner gas within the elastic cover 43 is not larger than a threshold value, the tiny vent 431 is sheltered in response to the elasticity of the elastic cover 43. Meanwhile, the tiny vent 431 is in a closed state (see FIG. 8). If the temperature increases abruptly, the gas within the sealed region 45 of the switch circuit board 42 is thermally expanded and the volume of the inner gas increases abruptly. Since the volume of the inner gas increases, the upper wiring plate 421, the lower wiring plate 422 and the separation layer 423 are subjected to deformation. Moreover, the volume of the gas within the elastic cover 43 is also increased. Due to the elasticity of the elastic cover 43, the increased volume of the inner gas is transferred to the elastic cover 43 and the elastic cover 43 is subjected to expansion. If the volume of the inner gas within the elastic cover 43 is larger than the threshold value, the elastic cover 43 is subjected to expansion again in response to the elasticity of the elastic cover 43 and the volume of the inner gas. Since the portion of the elastic cover 43 near the tiny vent 431 is propped open, the tiny vent 431 is in an opened state (see FIG. 9).

When the tiny vent 431 is in the opened state, the inner gas is exhausted to the sealed region 45 through the tiny vent 431 is in an opened state. The inner gas is continuously exhausted until the volume of the inner gas within the elastic cover 43 is not larger than the threshold value. Consequently, the tiny vent 431 is in the closed state. Meanwhile, the function of the elastic cover 43 is similar to the function of the elastic cover 23 as shown in FIG. 5. In this embodiment, the elastic cover 43 has the function of an exhaust valve to compensate the deformation of the switch circuit board 42. While the tiny vent 431 is opened, the pressure inside the switch circuit board 42 is higher than the pressure outside the switch circuit board 42. Under this circumstance, the foreign liquid cannot be introduced into the switch circuit board 42 through the tiny vent 431. Consequently, the elastic cover 43 with the tiny vent 431 still has the waterproof function.

In the above embodiments, the switch circuit board of the keyboard device is a three-layered structure. In some other embodiments, the elastic cover is applied to a two-layered switch circuit board. In the above embodiments, the elastic cover is disposed on the upper wiring plate or the lower wiring plate of the switch circuit board. It is noted that the position of the elastic cover is not restricted. For example, in another embodiment, the elastic cover is disposed on the separation layer, and the elastic cover is penetrated through the first opening of the upper wiring plate. In such way, the sealed region is also formed within the switch circuit board. In another embodiment, the elastic cover is inverted and disposed on the separation layer, and the elastic cover is penetrated through the first opening of the lower wiring plate. In such way, the sealed region is also formed within the switch circuit board.

From the above descriptions, the present invention provides the keyboard device. The elastic cover is disposed on the switch circuit board. Since no gas-escaping channel is installed in the switch circuit board, the sealed region in the switch circuit board can be maintained. Consequently, the keyboard device of the present invention has the waterproof function. When the temperature is changed and the inner gas within the switch circuit board is correspondingly changed, the elastic cover is subjected to expansion or contraction in response to the volume change of the inner gas and the elasticity of the elastic cover. Consequently, the distance between the first contact and the second contact of the switch circuit board can be maintained. In other words, the electric connection between the first contact and the second contact is established more easily and the problem of causing the erroneous operation is overcome.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

plural key structures exposed outside the keyboard device;

a switch circuit board located under the plural key structures, wherein when the switch circuit board is triggered by one of the plural key structures, a corresponding key signal is generated, wherein the switch circuit board comprises a hollow region;

an elastic cover disposed on the switch circuit board, wherein the hollow region is covered by the elastic cover, so that a foreign liquid is prevented from entering the switch circuit board; and a seal element disposed on sidewalls of the switch circuit board, so that a sealed region is formed between the switch circuit board and the elastic cover to prevent the foreign liquid from entering the switch circuit board, wherein when a volume of an inner gas within the sealed region increases, the elastic cover is subjected to expansion in response to elasticity of the elastic cover and the volume of the inner gas, wherein when the volume of the inner gas within the sealed region decreases, the elastic cover is subjected to contraction in response to elasticity of the elastic cover and the volume of the inner gas; wherein the switch circuit board comprises:

an upper writing plate comprising a first opening and a first contact;

a lower wiring plate located under the upper wiring plate, and comprising a second contact corresponding to the first contact; and a separation layer arranged between the upper wiring plate and the lower wiring plate, and comprising a second opening and a third opening, wherein the hollow region is defined by the first opening and the second opening collaboratively, and a key intersection is defined by the first contact, the second contact and the third opening collaboratively.

2. The keyboard device according to claim 1, wherein sidewalls of the upper wiring plate, sidewalls of the separation layer and sidewalls of the lower wiring plate are covered by the seal element, so that the seal element is disposed on the sidewalls of the switch circuit board, wherein the seal element is a waterproof adhesive.

3. The keyboard device according to claim 1, wherein the first opening is covered by the elastic cover from a top side of the upper wiring plate, and the elastic cover is fixed on the upper wiring plate by a hot pressing process or an attaching process.

4. The keyboard device according to claim 1, wherein the first opening is covered by the elastic cover from a bottom side of the lower wiring plate, and the elastic cover is fixed on the lower wiring plate through a waterproof adhesive.

5. The keyboard device according to claim 1, wherein the elastic cover further comprises a tiny vent, and the tiny vent runs through the elastic cover, wherein if the volume of the inner gas within the elastic cover is larger than a threshold value, the elastic cover is subjected to expansion in response to elasticity of the elastic cover and the volume of the inner gas and the tiny vent, so that the inner gas is escaped from the sealed region through the tiny vent, wherein if the volume of the inner gas within the elastic cover is not larger than the threshold value, the tiny vent is in a closed state in response to elasticity of the elastic cover.

6. The keyboard device according to claim 1, wherein the elastic cover is made of silicone rubber.

7. The keyboard device according to claim 1, wherein the keyboard device further comprises a base plate, wherein the base plate is located under the switch circuit board and connected with the plural key structures, wherein the plural key structures and the switch circuit board are supported by the base plate.

8. The keyboard device according to claim 7, wherein at least one key structure of the plural key structures comprises:

a keycap exposed outside the keyboard device;

a scissors-type connecting element connected with the keycap and the base plate, wherein the keycap is fixed on the base plate through the scissors-type connecting element, so that the keycap is movable relative to the base plate; and an elastic element arranged between the keycap and the switch circuit board, wherein when the elastic element is pushed by the keycap, the switch circuit board is triggered by the elastic element, wherein when the elastic element is not pushed by the keycap, the elastic element provides an elastic force to the keycap.

9. A keyboard device, comprising:

plural key structures exposed outside the keyboard device;

a switch circuit board located under the plural key structures, wherein when the switch circuit board is triggered by one of the plural key structures, a corresponding key signal is generated, wherein the switch circuit board comprises a hollow region;

an elastic cover disposed on the switch circuit board, wherein the hollow region is covered by the elastic cover, so that a foreign liquid is prevented from entering the switch circuit board; and a seal element disposed on sidewalls of the switch circuit board, so that a sealed region is formed between the switch circuit board and the elastic cover to prevent the foreign liquid from entering the switch circuit board, wherein when a volume of an inner gas within the sealed region increases, the elastic cover is subjected to expansion in response to elasticity of the elastic cover and the volume of the inner gas, wherein when the volume of the inner gas within the sealed region decreases, the elastic cover is subjected to contraction in response to elasticity of the elastic cover and the volume of the inner gas; wherein the switch circuit board comprises:

a lower wiring plate comprising a first opening and a second contact;

an upper wiring plate located over the lower wiring plate, and comprising a first contact corresponding to the second contact; and a separation layer arranged between the upper wiring plate and the lower wiring plate, and comprising a second opening and a third opening, wherein the hollow region is defined by the first opening and the second opening collaboratively, and a key intersection is defined by the first contact, the second contact and the third opening collaboratively.

* * * * *